United States Patent [19]

Neumann

[11] Patent Number: 4,491,075

[45] Date of Patent: Jan. 1, 1985

[54] SNUBBED RAILWAY CAR TRUCK

[75] Inventor: Otto W. Neumann, Itasca, Ill.

[73] Assignee: AMSTED Industries Incorporated, Chicago, Ill.

[21] Appl. No.: 378,202

[22] Filed: May 14, 1982

[51] Int. Cl.[3] ..... B61F 5/24

[52] U.S. Cl. ..... 105/207; 105/197 DB; 105/206 R

[58] Field of Search ..... 105/197 R, 197 D, 197 DB, 105/198, 206 R, 207, 226

[56] References Cited

U.S. PATENT DOCUMENTS

| | | | |
|---|---|---|---|
| 1,807,684 | 6/1937 | Barrows | 105/197 R |
| 2,055,278 | 9/1936 | Couch | 105/197 R X |
| 2,564,091 | 8/1951 | Baselt | 105/197 D |
| 4,357,880 | 11/1982 | Weber | 105/206 R |
| 4,370,933 | 2/1983 | Mulcahy | 105/207 X |

*Primary Examiner*—Randolph Reese

*Attorney, Agent, or Firm*—Charles E. Bouton; Fred P. Kostka

[57] ABSTRACT

A snubbed railway car truck including a side frame having a bolster opening defined by a pair of columns. A bolster end is disposed in the bolster opening. Resiliently biased friction shoes are provided with friction faces which engage friction faces of wear plates mounted on the columns. Lands are provided on the bolster and the side frame columns along the opposite upstanding edges of the friction plate. The lands are provided with planar stops which engage during permisible relative turning between the side frame and bolster. The lands are inclined relative to the plane of the wear plate friction surface to prevent gouging during relative turning movement of the bolster and side frame.

1 Claim, 4 Drawing Figures

SNUBBED RAILWAY CAR TRUCK

FIELD OF THE INVENTION

The present invention relates to railway car trucks and more particularly to an anti-rock and truck squaring retention arrangement therefore.

BACKGROUND OF THE INVENTION

Railway car trucks generally comprise a pair of wheel sets mounted on laterally spaced side frames. The side frames are mounted on the underside of a railway car by means of a bolster. The bolster extends transversely of the car and the opposite ends thereof extend through openings in the side frames. The bolster ends are resiliently supported in the side frames for limited vertical snubbed movement. Such snubbed movement is achieved by a resiliently supported friction shoe disposed between friction surfaces on the bolster and side frame.

To reduce wear of the truck structure and to improve the riding characteristics thereof it is desirable that the trucks be constructed to minimize or eliminate "rocking" and "lozenging". "Rocking" as used herein defines the tendency of the bolster to turn about its lengthwise axis relative to the side frames as occurs for example during humping. "Lozenging" as used herein is the tendency of the spaced side frames to turn about a vertical axis at the bolster ends so that the wheel sets and the side frames form in the nature of a parallelogram rather than remaining in substantially square or tram relationship.

U.S. Pat. Nos. 3,109,387 and 3,408,955 are illustrative of structures which have been used to minimize such lozenging and rotation. Generally both of the patent structures employ flat complementary surfaces formed on the bolster and side frames which are of sufficient length and width to maintain the lozenging and rotation to a minimum. The flat surfaces commonly designated as lands have been arranged in parallel relationship to the friction surface mounted on the side frame.

While the structure of the truck including the lands formed thereon are operative and effective to minimize the lozenging and rotation, there is still a limited amount of permissible relative turning of the bolster ends and side frame. During such "permissible turning" the upright edges of lands tend to gouge its complementary land so as to cause fatigue failure thereof. This failure of the land or stop surfaces requires repair of the surfaces as by welding or the like.

SUMMARY OF THE PRESENT INVENTION

By the present invention it is proposed to provide a land structure which overcomes the difficulties encountered heretofore.

This is accomplished generally by the formation of complementary lands or stop surfaces provided on the bolster and side frame so that during permissible turning the surfaces tend to engage in face-to-face relationship rather than in edge-to-edge engagement as has occurred heretofore.

Briefly, the truck structure embodying the present invention comprises a side frame having an opening defined by a pair of lengthwise spaced columns. A bolster end extends through said opening and is resiliently supported therein by spring means. Disposed in pockets formed along the opposite sides of the bolster end are friction shoes which have friction faces engagable with friction surfaces on the inner faces of the column. The shoes are resiliently urged upwardly by a control spring which serves to bias the shoes into engagement with the friction surfaces.

The stop surfaces which serve to reduce horizontal turning of the bolster relative to the side frame in accordance with the improved structure of the present invention are provided by lands formed along each side of the side frame friction plate and by complementary lands provided on the bolster ends for engagement with the side frame lands. The side frame lands are formed so that the land or stop surfaces thereof are at an angle relative to the vertical and planar friction surface with the inner edges thereof lying substantially in the plane of the friction surface. The lands or stop surfaces along the bolster end are arranged at an angle to the vertical plane in which the friction surfaces lie so as to abut the side frame lands in face-to-face relationship.

The above described angled land arrangement results in the diagonally opposite lands making surface and face-to-face contact along the angled lands during relative turning of the bolster end and side frames about a vertical axis.

BRIEF DESCRIPTION OF THE PREFERRED EMBODIMENT

Figure 1:
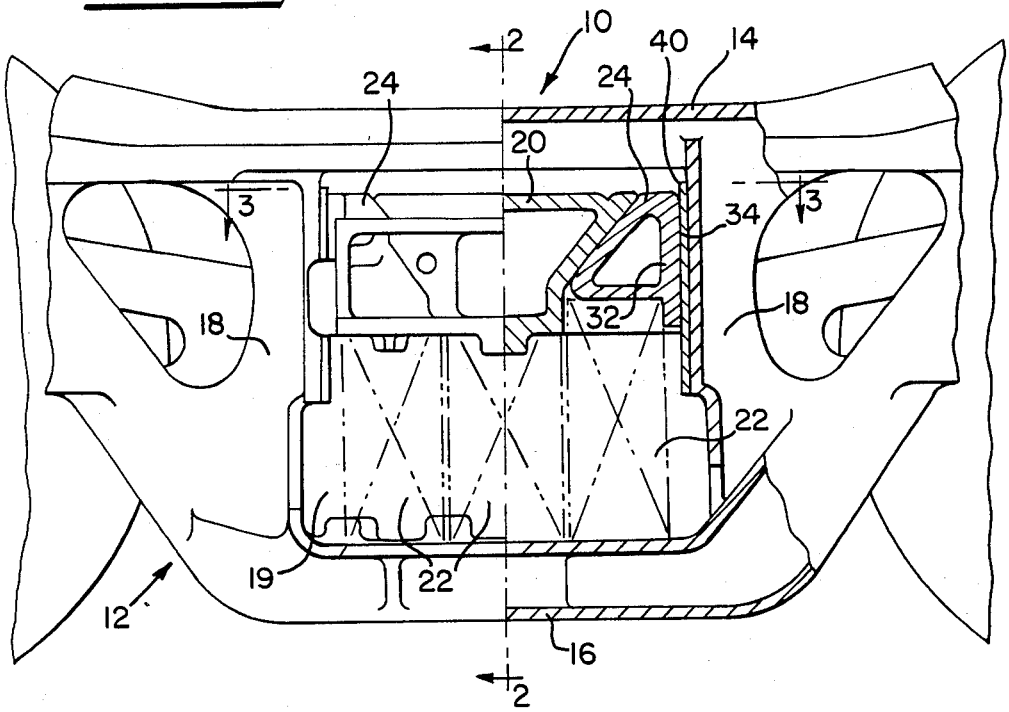
FIG. 1 is a fragmentary side elevational view of a railway car truck embodying the structure of the present invention with some of the parts being broken away to show underlying details of structure.
Figure 2:
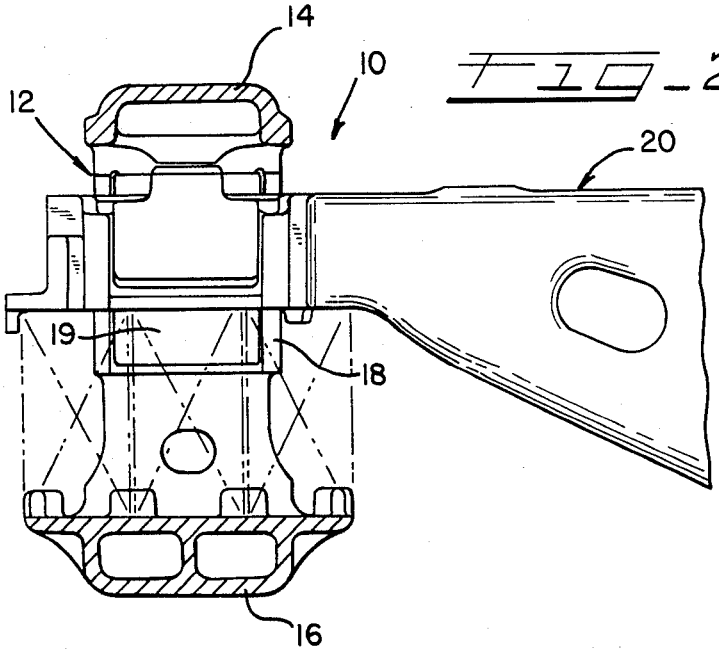
FIG. 2 is a cross sectional view taken generally along the lines 2—2 of FIG. 1.

Referring now to the drawings there is shown a truck 10 embodying the structure of the present invention. The truck 10 comprises generally a side frame 12 including a compression member 14, a tension member 16 interconnected by spaced upright column members 18. The members 14, 16 and 18 define a window 19 which receives one end of a bolster 20. The bolster 20 is resiliently supported by springs 22 in the well known manner.

In order to stabilize the relative vertical movement between the bolster 20 and the side frame 12 there is provided a pair of friction shoes 24. The friction shoes 24 are disposed in friction shoe pockets 26 formed on opposite sides of the bolster 20. The pockets 26 are each formed to guide the shoe 24 therein for vertical movement. Each shoe 24 may be generally wedge shaped having an inclined wedge wall 30 and a vertical wall 32 having a friction face 34. The friction face 34 is formed on the outboard face of the vertical wall which is provided with lateral projections 36 which are accommodated for guiding movement between gibs 38 projecting into the pocket.

The spring 22 is operative to urge the friction shoe 24 upwardly in a pocket 26 so that the friction face 34 is forced into frictional engagement with a replaceable wear plate 40 on the side frame column 18. The wear plate 40 provides a planar friction surface 42 and is seated and fixed as by welding in a vertically extending recess 44 formed in the column 18. The recess 44 is defined by a lengthwise spaced pair of upstanding ribs 45 having a substantially flat surface or lands 46 facing inward adjacent the friction surface 42 of the wear plate 40 and each surface or land 46 is engageable with an outboard facing planar surface or land 48 provided on the gibs 38. This arrangement of the upstanding ribs 45 with the planar land surface 46 and the gibs 38 with planar land 48 serves to provide stop surfaces which restrict relative motion between the side frames and bolster.

Heretofore the planar surfaces or lands have been disposed parallel to the wear plate friction surface and the planar surface or lands on the gibs were parallel thereto when the bolster and side frame axis X and Y are normal to each other. With the stop surfaces arranged in this manner, upon relative limited turning of the bolster and side frame so that the axis X and Y respectively are out of normal arrangement or tram, the outboard edges of the lands tend to gouge the opposing lands resulting in wear which causes the surfaces to break down so that the truck lozenges.

Figure 4:
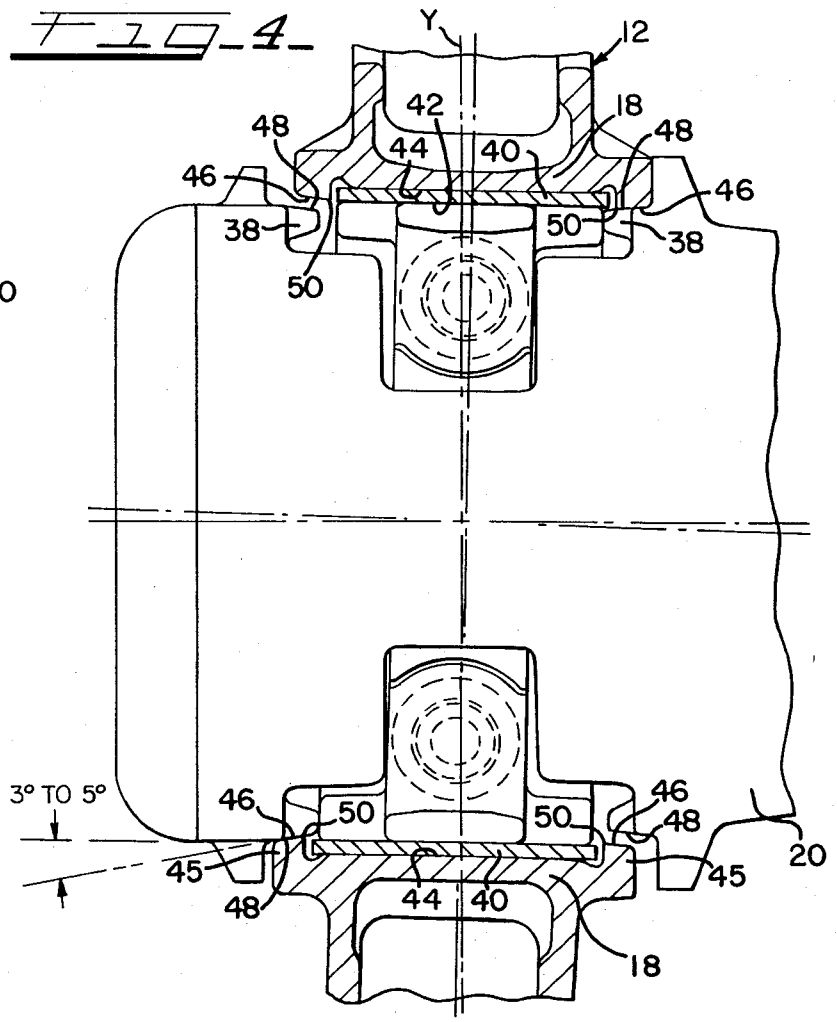
FIG. 4 is a view similar to FIG. 3 but showing the relationship of the components when the bolster ends and side frame rotate about vertical axes as occurs when the truck is out of tram.
Figure 3:
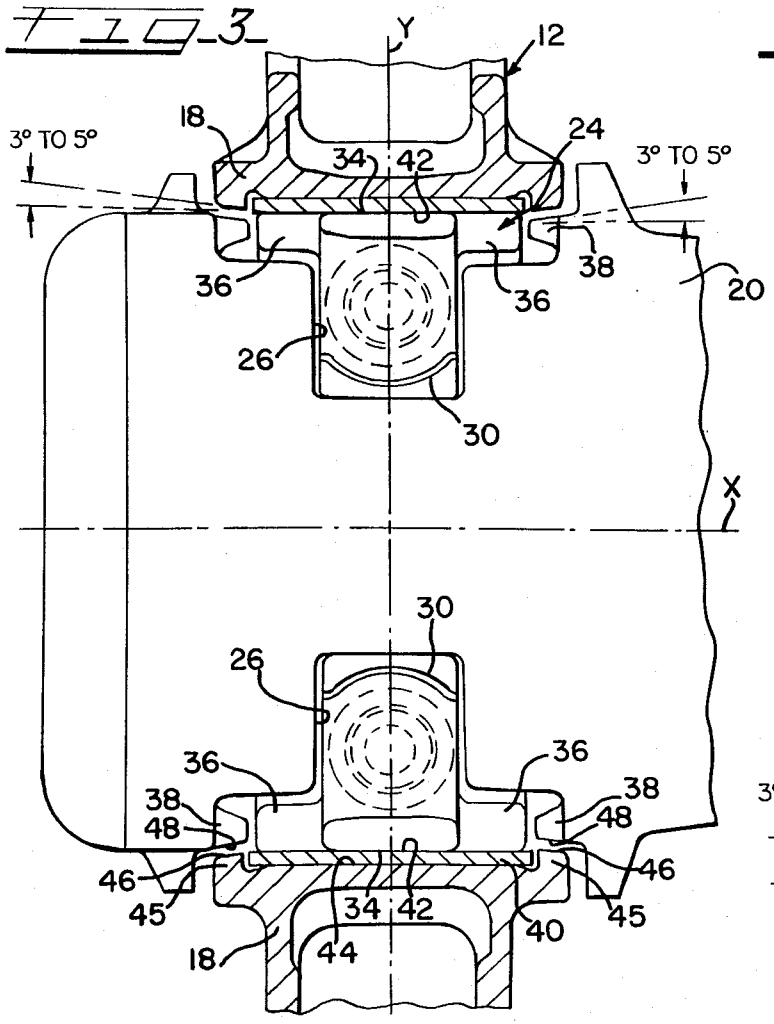
FIG. 3 is an enlarged plan view in partial section with certain parts removed taken generally along the lines 3—3 of FIG. 1.

By the present invention as shown in particular in FIG. 3 and FIG. 4 the land or stop surfaces 46 and 48 are each inclined relative to the planar friction surface 42 of the wear plate 40. The inner edge 50 of each of the lands or stop surfaces on ribs 45 is arranged to lie in the plane of the friction surface 42 of wear plate 40; and the stop surfaces 46 extending from the edge 50 are inclined away from the adjacent side walls of the bolster 20. The bolster lands 48 are similarly inclined so as to be parallel with the side frame lands 46. Preferably the bolster lands and side frame lands are inclined at an angle of 3° to 5° relative to their respective friction faces 34 and friction surfaces 42 as shown in FIGS. 3 and 4.

With the stop surface 46 and 48 thus inclined upon relative turning of the bolster and side frame about a vertical so that the axis X and Y are out of tram or squaring, as shown the opposing lands 46 and 48 contact each other over a span of the surface area and thereby preclude the edge contact which resulted in the adverse gouging encountered heretofore.

What is claimed is:

1. In a railway vehicle truck including a side frame having a bolster opening defined by a pair of longitudinally spaced upright columns, a bolster having an outer end extending through said opening and resiliently supported therein for limited vertical mounted movement and friction shoes disposed on opposite sides of said bolster and having friction faces engageable with vertically disposed planar friction surfaces on said columns, the improvement comprising: side frame lands formed along and closely adjacent to the opposite sides of each of said friction surfaces on said columns and projecting toward said bolster, planar bolster lands formed along the vertical sides of said bolster engageable in opposing relationship with respective ones of said side frame lands, said side frame lands each having a planar surface inclined at an angle of between about 3° to 5° from the planar friction surface on said column, and said bolster lands inclined substantially parallel to said inclined planar surfaces of the respective ones of said side frame lands.

* * * * *